United States Patent [19]

Ofosu-Asante et al.

[11] Patent Number: 5,066,425

[45] Date of Patent: Nov. 19, 1991

[54] FORMATION OF HIGH ACTIVE DETERGENT PARTICLES

[75] Inventors: Kofi Ofosu-Asante; Scott E. Stephans, both of Cincinnati, Ohio

[73] Assignee: The Procter & Gamble Company, Cincinnati, Ohio

[21] Appl. No.: 552,663

[22] Filed: Jul. 16, 1990

[51] Int. Cl.[5] ..... C11D 1/12; C11D 3/33; C11D 1/72

[52] U.S. Cl. ..... 252/546; 252/550; 252/174; 252/174.23; 252/DIG. 11; 252/174.21

[58] Field of Search ..... 252/546, 174.23, 550, 252/174, DIG. 11, 174.21

[56] References Cited

U.S. PATENT DOCUMENTS 3,597,361 8/1971 Sumner ..... 252/161
3,855,156 12/1974 Marumo ..... 252/547
4,869,843 9/1989 Saito et al. ..... 252/135

FOREIGN PATENT DOCUMENTS 48-61511 8/1973 Japan .

*Primary Examiner*—Paul Lieberman
*Assistant Examiner*—Erin M. Higgins
*Attorney, Agent, or Firm*—Kathleen M. Harleston; Donald E. Hasse; Thomas H. O'Flaherty

[57] ABSTRACT

A process for producing high active detergent particles including reacting the acid form of anionic surfactant with an alkali metal hydroxide solution in a continuous neutralization system, and adding to the system an α-aminodicarboxylic acid selected from the group consisting of glutamic acid, aspartic acid, aminomalonic acid, aminoadipic acid, and 2-amino-2-methylpentanediotic acid, or their salts. Mono- and disodium glutamate are preferred.

17 Claims, No Drawings

FORMATION OF HIGH ACTIVE DETERGENT PARTICLES

FIELD OF THE INVENTION

The present invention relates to a process for producing high active detergent particles which includes reacting in a continuous neutralization system the acid form of an anionic surfactant with alkali metal hydroxide and adding to the neutralization system during formation of the neutralized product an α-aminodicarboxylic acid selected from the group consisting of glutamic acid, aspartic acid, aminomalonic acid, aminoadipic acid, and 2-amino-2-methylpentanedioic acid, or their alkali metal salts. High active detergent particles formed from the neutralized product are included.

BACKGROUND INFORMATION

There is currently interest in the detergent industry in concentrated detergent products. These products provide advantages to the consumer, who has a product which can be used in lower amounts and is more easily stored, and to the producer and intermediates, who have lower transportation and warehousing costs. A major difficulty, though, is finding an inexpensive and efficient way to produce a high active detergent particle for inclusion in a concentrated detergent product. By "high active" is meant greater than about 50% active by weight of the detergent particles is anionic surfactant.

The traditional method for producing detergent granules is spray drying. Typically, detergent ingredients such as surfactant, builder, silicate and carbonate are mixed in a mix tank to form a slurry which is about 35% to 50% water. This slurry is then atomized in a spray drying tower to reduce moisture to below about 10%. It is possible to compact spray dried particles to make dense detergent granules. See U.S. Pat. No. 4,715,979, Moore et al., issued Dec. 29, 1987. However, the use of spray drying to make condensed granules has some disadvantages. Spray drying is energy intensive and the resulting granules are typically not dense enough to be useful in a concentrated detergent product. Spray drying methods generally involve a limited amount (less than 40%) of organic components such as surfactant for environmental and safety reasons.

One way to reduce the energy required to spray dry detergent granules is to reduce the moisture in the slurry which is atomized in the spray drying tower, i.e., by reducing the evaporative load. An alternative method for making a high active detergent particle is by continuous neutralization in, for example, a continuous neutralization loop. There are continuous neutralization loops available to which relatively concentrated caustic can be added. Using a caustic solution which is about 50% sodium hydroxide allows reduction of moisture in the resulting neutralized surfactant paste to about 16% water.

The following publications describe ways to make free-flowing high active particles without drying, using surfactant paste, and made with a continuous neutralization system: Japanese Patent 61-118500, Hara et al., laid-open June 5, 1986, Japanese Patent 60-072999, Satsusa et al., laid open Apr. 25, 1985, U.S. Pat. No. 4,515,707, Brooks, issued May 7, 1985, U.S. Pat. No. 4,162,994, Kowalchuk, issued July 31, 1979, and European Patent 266847-A.

The use of polyethylene glycol and ethoxylated nonionic surfactants in granular detergent compositions is known in the art: e.g. Japanese Patent 61-231099, Sai et al., laid-open Oct. 15, 1986, Japanese Patent 62-263299, Nagai et al., laid-open Nov. 16, 1987, U.S. Pat. No. 4,639,326, Czempik et al., issued Jan. 27, 1987, and U.S. Pat. No. 3,838,072, Smith et al., patented Sept. 24, 1974.

The following patents describe processes and/or surfactant compositions comprising viscosity modifiers such as polyethylene glycol and ethoxylated ($E_{20-60}$) alkyl ($C_{6-12}$) phenol: U.S. Pat. No. 4,482,470, Reuter et al., issued Nov. 13, 1984, U.S. Pat. No. 4,495,092, Schmid et al., issued Jan. 22, 1985, U.S. Pat. No. 4,532,076, Schmid et al., issued July 30, 1985, U.S. Pat. No. 4,675,128, Linde et al., issued June 23, 1987, and U.S. Pat. No. 4,772,426, Koch et al., issued Sept. 20, 1987.

It has been found that an improved high active surfactant paste, and therefore better detergent granules, can be made by adding to a continuous neutralization system, along with the acid form of an anionic surfactant and alkali metal hydroxide, an α-aminodicarboxylic acid selected from the group consisting of glutamic acid, aspartic acid, aminomalonic acid, aminoadipic acid, and 2-amino-2-methylpentanedioic acid, or their alkali salts, particularly monosodium glutamate. Monosodium glutamate (MSG) is popular throughout the world as a flavor enhancer. It is used in many Western packaged foods and in Asian countries alongside salt and pepper. Kirk-Othmer *Encyclopedia of Chemical Technology.* H. F. Mark et al., John Wiley & Sons, NY (1978), 3rd ed., vol. 4, pp. 410–421. These α-aminodicarboxylic acids are not to our knowledge known to be useful in detergent-making processes, for preventing discoloration of high-active detergent particles or for improving processability.

The following publications describe detergent compositions containing amino di-acid components such as glutamic acid and its salts.

U.S. Pat. No. 3,872,020, Yamagishi et al, issued Mar. 18, 1975 discloses a detergent composition having good transparency and detergency, which preserves freshness of food and the like, and which comprises a certain sucrose ester component and an organic acid component. The latter is malic acid and/or tartaric acid and/or alkaline salts of either. The composition preferably further includes a saccharide component and/or an amino acid component, typically glutamic acid, alkali salts of glutamine acid, glycine and/or alkali salts of glycine. The amino acid component, e.g. sodium glutamate, is added to impart a freshness preservation ability to food to be washed (Col. 4, lines 10–16).

U.S. Pat. No. 4,046,717, Johnston et al, issued Sept. 6, 1977, discloses a bar soap which is said to be given a skin moisturizing effect by including a water soluble lactate and/or glutamate salt. The glutamate salt and/or lactate are described as additives effective to increase the water content of human skin (Col. 1, lines 17–29).

Japanese Publication 61-108387 discloses a method for stabilizing alkali proteases in detergent compositions by combining amino acid or its salt and, for improved stabilization, calcium salt.

Japanese Publication 60-243199 discloses a two-phase liquid detergent composition containing 10–50 wt. % of at least one anionic and/or nonionic surfactant, and 2–30 wt. % carboxylic acid. The components of the composition are said to separate on standing and can be mixed together.

German Offen. 1,942,236 discloses enzyme-containing detergent compositions containing anionic, zwitterionic, or nonionic surfactants and builders, and for improved protein stain-removing efficiency, 2–15% S-free $C_{4-11}$-amino acid or its water-soluble salt; optionally containing ≧1 additional $CO_2H$ or amino group (including glutamic acid).

Copending patent application Ser. No. 516,292, Wise et al, filed May 4, 1990 describes light duty liquid or gel dishwashing detergent compositions containing an alkyl ethoxy carboxylate surfactant. Disodium glutamate is mentioned as a preferred buffer therein.

SUMMARY OF THE INVENTION

The present invention relates to a process for producing high active detergent particles, comprising the steps of:

(a) reacting in a continuous neutralization system, the acid form of an anionic surfactant with an alkali metal hydroxide solution, which is about 30 to 75% by weight of the hydroxide and is present in stoichiometric amount to slight stoichiometric excess, to produce a neutralized product;

(b) adding to said continuous neutralization system, during formation of said neutralized product, an α-aminodicarboxylic acid selected from the group consisting of glutamic acid, aspartic acid, aminomalonic acid, aminoadipic acid, and 2-amino-2-methylpentanedioic acid, or their alkali metal salts; and (c) forming detergent particles from the product of step (b), said particles comprising from about 50 to 90 weight % of the anionic surfactant and from about 0.2 to 15 weight % of the α-aminodicarboxylic acid salt.

DESCRIPTION OF THE INVENTION

This invention includes a process for producing high active detergent particles, and detergent particles made by this process. By "high active" is meant more than about 50% by weight of the detergent particles is anionic surfactant. These high active particles allow for a more concentrated granular laundry detergent product. The detergent particles are formed from a neutralized paste made by reacting in a continuous neutralization system the acid form of an anionic surfactant with an alkali metal hydroxide solution, which is about 30 to 75% by weight of the hydroxide and is present in stoichiometric amount to slight stoichiometric excess (0 to about 5, preferably 0 to about 1, weight % expressed as sodium hydroxide), to produce a neutralized product. An α-aminodicarboxylic acid selected from the group consisting of glutamic acid, aspartic acid, aminomalonic acid, aminoadipic acid, and 2-amino-2-methylpentanedioic acid, or their alkali metal salts (including mixtures thereof) are added to the continuous neutralization system during formation of the neutralized (paste) product.

The benefits of adding the α-aminodicarboxylic acid/salt component are threefold. It provides good alkalinity control during neutralization and is an effective buffer for this process. Surprisingly, it also reduces the viscosity of the neutralized product (paste) in the neutralization system, particularly where mono- and disodium glutamate are used with alkyl sulfate and/or linear alkyl benzene sulfonate, which improves processability. Lastly, it solves the problem of discoloration of high active detergent particles. Without this α-aminodicarboxylic acid/salt component, the neutralized product can be off-white in color, and detergent particles made from the neutralized product may become discolored over time. Ween perfume is sprayed on high active detergent particles of alkyl sulfate and linear alkyl benzene sulfonate, for example, they turn from off-white to an unacceptable dark yellow. Perfume impact may be reduced. With the α-aminodicarboxylic acid/salts component, discoloration is not observed.

I. Acid and Caustic

The acid form of an anionic surfactant is reacted in a continuous neutralization system with an alkali metal hydroxide solution, which is about 30 to 75, preferably 50 to 75, most preferably 62 to 73, % by weight of the hydroxide. The acid form of anionic surfactant is preferably the acid form of $C_{12-18}$ alkyl sulfate- ("HAS"), $C_{12-18}$ alkyl ether sulfate ("HAES"), $C_{10-16}$ linear alkyl benzene sulfonate ("HLAS"), $C_{12-18}$ fatty acid (particularly coconut fatty acid), and/or $C_{12-18}$ methyl ester sulfonate ("HMES"). $C_{12-18}$ methyl ester sulfonate has the structure:

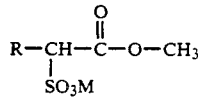

where R is an alkyl group and M is hydrogen or a soluble salt. More preferred are $C_{12-18}$ HAS, mixtures of $C_{12-18}$ HAS and $C_{10-16}$ HLAS, and mixtures of $C_{12-18}$ HAS and $C_{12-18}$ fatty acid. Most preferred are $C_{14-16}$ HAS, and mixtures of $C_{14-16}$ HAS and $C_{11-14}$ HLAS. The HAS and HLAS can be prepared by a known sulfation/sulfonation process, and is preferably made using a falling film $SO_3$ reactor. See *Synthetic Detergents,* 7th ed., A. S. Davidson & B. Milwidsky, John Wiley & Sons, Inc., 1987, pp. 151–168. Mixtures of HAS and HLAS are preferred because of improved dispersibility of detergent particles formed from a paste made with the mixture. The two acids can be added as separate streams to the continuous neutralization system or mixed before addition. Alternatively, pastes made from each separate acid can be mixed after neutralization.

In this process, it is preferred that the final weight ratio of the preferred $C_{12-18}$ sodium alkyl sulfate to $C_{10-16}$ sodium linear alkyl benzene sulfonate be between 75:25 and 96:4, preferably between 80:20 and 95:5. (Sodium hydroxide is the preferred alkali metal hydroxide.)

An 88:12 weight ratio of $C_{14-15}$ sodium alkyl sulfate to $C_{12-13}$ sodium linear alkyl benzene sulfonate is most preferred because the neutralized paste is not unacceptably sticky, yet the particles formed from the paste are dispersible in 60° F. (15.5° C.) water. Paste made from about 100% $C_{14-15}$ HAS (including impurities) is in contrast not very dispersible in cool (60° F.; 15.5° C.) water despite its desirable consistency. Paste made from HLAS alone is soft and sticky and therefore difficult to form into nonsticky, discrete surfactant particles.

The acid form of $C_{14-16}$ alkyl sulfate is preferred for use in this process. The acid form of $C_{14-15}$ alkyl sulfate is most preferred.

The acid form of $C_{11-14}$ linear alkyl benzene sulfonate is preferred. The acid form of $C_{12-13}$ linear alkyl benzene sulfonate is most preferred for use herein.

The alkali metal hydroxide used to neutralize the HAS and HLAS is about 30 to 75%, preferably about 50 to 75%, most preferably about 62 to 73%, by weight of the hydroxide. Where 62 to 73% concentrated caustic is used, the cooler in the system must be carefully maintained at the required temperature to prevent "cold spots". A "cold spot" is any point in the feed system, pumps, metering systems, pipes or valves where the system has reached a temperature below the melting point of the caustic (155° F. or 68.3° C. for 70% caustic, for example). Such a "cold spot" can cause crystallization of the caustic and blockage of the feed system. Typically "cold spots" are avoided by hot water jackets, electrical tracing, and electrically heated enclosures.

Sodium hydroxide, preferably about 70% solids, is the preferred alkali metal hydroxide.

The neutralized product formed by the acid and caustic is in the form of a molten paste. When about 62% active caustic is used, the molten paste ordinarily has about 12% by weight of water. When 70% active caustic is used, the molten paste ordinarily has between about 8 and 10% by weight of water. It is most preferred that the alkali metal hydroxide be about 70% by weight of hydroxide.

When combined with the α-aminodicarboxylic acid/salt component, a 1% solution of the product of step (b) in water at a temperature of about 150° F. (65.5° C.) will preferably have a pH between about 8.5 to 10.5, preferably 9.0 to 9.5.

The anionic surfactant acid and caustic are put into the continuous neutralization system separately, preferably at the high shear mixer so that they mix together as rapidly as possible.

Generally, in a continuous neutralization loop, the ingredients enter the system through a pump (typically centrifugal) which circulates the material through a heat exchanger in the loop and back through the pump, where new materials are introduced. The material in the system continually recirculates, with as much product exiting as is entering. Product exits through a control valve which is usually after the pump. The recirculation rate of a continuous neutralization loop is between about 1:1 and 50:1. The temperature of the neutralization reaction can be controlled to a degree by adjusting the amount of cooling by the heat exchanger. The "throughput" can be controlled by modifying the amount of anionic surfactant acid and caustic introduced.

The continuous neutralization loop should be modified as follows to practice this process using the very concentrated (about 62 to 73% solids) caustic:

(1) Insulate the loop;
(2) Change the centrifugal pump to a positive displacement pump, which is better able to handle very viscous material;
(3) Install a cooler which can handle concentrated paste;
(4) Introduce materials through a high shear mixer installed in-line;
(5) Install a metering system for the polyethylene glycol and/or ethoxylated nonionic surfactant, preferably after the high shear mixer; and
(6) Position the incoming streams of acid and caustic at the high shear mixer so that the highest degree of mixing possible takes place.
(7) The temperature of the loop should be as low as possible, to minimize hydrolysis, yet maintain adequate recirculation and mixing. Typical paste temperatures in the loop are between about 180° F. (82.2° C.) and 230° F. (110° C.), preferably about 200° F. (93.3° C.) to 210° F. (98.9° C.).

The neutralized product preferably has less than or equal to about 12%, preferably 8 to 10%, by weight of water.

II. α-Aminodicarboxylic Acid/Salts

During formation of the neutralized product in the continuous neutralization system, preferably a continuous high active neutralization loop (Chemithon Corp., Seattle, Wash.) modified as indicated above, one or more α-aminodicarboxylic acids selected from the group consisting of glutamic acid, aspartic acid, aminomalonic acid, aminoadipic acid, and 2-amino-2-methylpentanedioic acid, or their alkali metal salts, are added to the system. Alkali metal salts of glutamic acid and/or aspartic acid are preferred. Monosodium and/or disodium glutamate are most preferred.

| Component | Structure | pKa |
|---|---|---|
| Aspartic acid (L-Aminobutanedioic acid) | $HO_2CCH_2CH(NH_2)CO_2H$ | 10.02 at 25° C. and 0 ionic strength |
| Glutamic acid (L-2-Aminopentanedioic acid) | $HO_2CCH_2CH_2CH(NH_2)CO_2H$ | 9.95 at 25° C. and 0 ionic strength |
| Aminomalonic acid (Aminopropanedioic acid) | $HO_2CCH(NH_2)CO_2H$ | 9.30 at 20° C. and 0 ionic strength |
| Aminoadipic acid (DL-2-Aminohexanedioic acid) | $HO_2CCH_2CH_2CH_2CH(NH_2)CO_2H$ | 9.15 at 25° C. and 0.16 ionic strength |
| DL-2-Amino-2-methylpentanedioic acid | $HO_2CCH_2CH_2C(NH_2)(CH_3)CO_2H$ | 9.71 at 25° C. and 0.1 ionic strength |

See *Critical Stability Constants,* A. E. Martell and R. M. Smith, Vol. 1: Amino Acids, (Plenum Press, NY & London, 1974), pp. 23–29, 395; and *Merck Index,* 8th ed. (Merck & Co., Rahway, N.J., 1968), p. 52.

It has been found that this α-aminodicarboxylic acid/salt component has several surprising benefits in this process. Without this component, the neutralized paste product is off-white in color. When perfume is sprayed on detergent particles made without this component, they turn an unacceptable dark color. After several days, perfume impact can be reduced to a low level. (See Example III.) When disodium glutamate (DSG) for example is added to the neutralization loop, the neutralized paste product, and detergent particles made from the paste, are surprisingly white in color. No discoloration is observed when perfume is sprayed on the detergent particles. Perfume impact is good and the particles are acceptable for use in granular laundry products. The DSG provides good alkalinity control in the neutralization loop and is an effective buffer. It surprisingly reduces paste viscosity and improves processability. DSG can be made from crystalline monosodium glutamate, which is readily available and inexpensive, by dissolving in water and titrating with 50% sodium hydroxide. This α-aminodicarboxylic acid/salt component is preferably added by a metering system into the neutralization loop at the discharge side of the high shear mixer.

In contrast, when sodium carbonate, a commonly used buffer for neutralization systems, is employed, the neutralized product is unacceptable due to stickiness and carbon dioxide gas bubbles which form during neutralization. Paste and detergent particle discoloration is not observed, although flake product odor is not acceptable (see Example II).

Without meaning to be bound by theory, it is believed that the mechanism whereby these α-aminodicarboxylic acids and/or their salts prevent discoloration is as follows. Since discoloration of the neutralized surfactant paste and detergent particles made from the paste seems to occur even without the addition of perfume, it appears that aldehydes from the perfumes and/or from oxidation of the additive polyethylene glycol, and/or from oxidation of primary alcohols in the surfactant paste remaining from sulfation, are causing the discoloration. These aldehydes probably react with the α-aminodicarboxylic acids/salts, especially mono- or disodium glutamate, preventing the aldehydes from further reaction and thus preventing discoloration.

III. Polyethylene Glycol and/or Ethoxylated Nonionic Surfactant

It is preferred that polyethylene glycol (most preferred) and/or ethoxylated nonionic surfactant be added to the continuous neutralization system during formation of the neutralized product. The polyethylene glycol preferably has a molecular weight of between about 4,000 and 50,000, more preferably between about 7,000 and 12,000, most preferably about 8,000 ("PEG 8,000"). The ethoxylated nonionic surfactant is preferably of the formula $R(OC_2H_4)_nOH$, wherein R is a $C_{12-18}$ alkyl group or a $C_{8-16}$ alkyl phenol group and n is from about 9 to about 80, with a melting point greater than or equal to about 120° F. (48.9° C.). The weight ratio of the additive of step (b) to the ingredients of step (a) is preferably from about 1:5 to 1:20.

The polyethylene glycol and/or the ethoxylated nonionic surfactant can be added separately or as a mixture to the continuous neutralization system. In a neutralization loop, these additive(s) preferably enter the loop after the high shear mixer and before the recirculation pump. The additives must be melted before addition to the neutralization system, so that they can be metered in.

These additives are chosen because they enhance detergent performance and are solid at below about 120° F. (48.9° C.), so that a detergent particle which is firm at ambient temperature can be made from the neutralized paste. Each additive also acts as a process aid by somewhat reducing the viscosity of the high active paste in the neutralizer loop.

The preferred weight ratio of polyethylene glycol to the acid/caustic mixture of step (a) is from about 1:8 to about 1:12. For polyethylene glycol with a molecular weight of 8,000, the preferred weight ratio is one part PEG 8,000 to ten parts acid/caustic mixture.

Polyethylene glycol is formed by the polymerization of ethylene glycol with ethylene oxide in an amount sufficient to provide a compound with a molecular weight between about 4,000 and 50,000. It can be obtained from Union Carbide (Charleston, W. Va.).

The preferred ethoxylated nonionic surfactant material is of the formula $R(OC_2H_4)_nOH$, wherein R is a $C_{12-18}$ alkyl group and n is from about 12 to about 30. Most preferred is tallow alcohol ethoxylated with 18 moles of ethylene oxide per mole of alcohol ("TAE 18"). The preferred melting point for the ethoxylated nonionic surfactant is greater than about 140° F. (60° C.)

Examples of other ethoxylated nonionic surfactants herein are the condensation products of one mole of decyl phenol with 9 moles of ethylene oxide, one mole of dodecyl phenol with 16 moles of ethylene oxide, one mole of tetradecyl phenol with 20 moles of ethylene oxide, or one mole of hexadecyl phenol with 30 moles of ethylene oxide.

IV. Formation of Particles

The final step of this process is forming detergent particles from the product of step (b). The detergent particles herein comprise from about 50 to 90, preferably 60 to 85, most preferably 75 to 85, weight % of the anionic surfactant and from about 0.2 to 15, preferably 1 to 10, most preferably 1.5 to 5, weight % of the α-aminodicarboxylic acid salt. Detergent particles can be formed in various ways from the neutralized product exiting the continuous neutralization system. A desirable detergent particle size distribution has a range of about 100 to 1200 microns, preferably about 150 to 600 microns, with an average of 300 microns.

The molten paste from a continuous neutralization loop can be atomized into droplets in a prilling (cooling) tower. To avoid prilling at all, the molten neutralized product can be simultaneously cooled and extruded, and cut or ground into desirable particle sizes (a second and preferred choice).

A third choice is to allow the molten paste to cool on a chill roll, or any heat exchange unit until it reaches a doughy consistency, at which point other detergent ingredients can be kneaded in. The resulting dough can then be granulated in a high shear mixer using a fine powder of less than about 200 microns average particle diameter, preferably less than about 20 microns, or it can be granulated by mechanical means.

A fourth and most preferred choice is to allow the molten paste to cool completely on a chill roll or chilled belt unit until it is solid. The thin, hardened layer of solidified product can then be scraped off the chill roll or belt and broken into flakes. The flakes can either be mechanically ground into detergent particles (and screened for desired particle sizes) or preferably further dried (before mechanically grinding) to improve particle crispness (preferably below about 5% moisture). Should further drying be necessary, care must be taken not to overheat the flakes since overheating can cause hydrolysis of the alkyl sulfate, for example.

The resulting detergent particles can be used as is, but are preferably admixed into a finished detergent composition. For example, the instant detergent particles can be admixed with spray dried linear alkyl benzene sulfonate particles (with or without detergency builder) to make a granular detergent product.

Appropriate finished detergent compositions contain from about 5 to 95% by weight of the instant high active detergent particles, from 0 to about 95% by weight of additional detergent surfactant, from 0 to about 85% by weight of detergency builder, from 0 to about 50% by weight of fabric care agent, and from 0 to about 20% by weight of bleaching agents.

The additional detergent surfactant referred to immediately above is selected from the group consisting of anionic, cationic, nonionic, amphoteric, and zwitterionic surfactants, and mixtures thereof. Examples of surfactants of these types are described in U.S. Pat. No. 3,579,454, Collier, issued May 18, 1971, incorporated herein by reference, from Column 11, line 45 through Column 13, line 64. An extensive discussion of surfactants is contained in U.S. Pat. No. 3,936,537, incorporated herein by reference, particularly Column 11, line 3 through Column 13, line 52. Anionic synthetic surfactants are particularly preferred.

Cationic surfactants can also be included in such finished detergent compositions. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Other optional ingredients which may be included in the finished detergent compositions herein include detergency builders, chelating agents, bleaching agents, antitarnish and anticorrosion agents, perfume and color additives, and other optional ingredients enumerated in the Baskerville patent, U.S. Pat. No. 3,936,537, from Column 19, line 53 through Column 21, line 21, incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference. Detergency builders are enumerated in the Baskerville patent from Column 13, line 54 through Column 16, line 16, and in U.S. Pat. No. 4,663,071, Bush et al., issued May 5, 1987, both incorporated herein by reference. Such builders include, for example, phosphates, aluminosilicates, silicates, carbonates. $C_{10}$–$C_{18}$ alkyl monocarboxylates, polycarboxylates, and polyphosphonates, and mixtures thereof.

Fabric care agents are optionally included in such finished detergent compositions. These include known fabric softeners and antistatic agents, such as those disclosed in U.S. Pat. No. 4,762,645, Tucker et al., issued Aug. 9, 1988, incorporated herein by reference. The smectite clays described therein can also be included in the finished detergent compositions.

Percarboxylic acid bleaching agents, or bleaching compositions containing peroxygen bleaches capable of yielding hydrogen peroxide in an aqueous solution and bleach activators at specific molar ratios of hydrogen peroxide to bleach activator, can also be included. These bleaching agents are fully described in U.S. Pat. No. 4,412,934, Chung et al., issued Nov. 1, 1983, and in U.S. Pat. No. 4,483,781, Hartman, issued Nov. 20, 1984, both of which are incorporated herein by reference.

The following components are preferably not added to the continuous neutralization system: sucrose ester component, water soluble lactate, and alkali proteases or other enzymes. The detergent particles are preferably to be incorporated into granular laundry detergent compositions, rather than bar soaps or liquid or gel detergent compositions.

The following nonlimiting examples illustrate the process and detergent particles of the present invention. All parts, percentages and ratios herein are by weight unless otherwise specified.

EXAMPLE I

Neutralization of High Active AS/LAS Paste with Sodium Glutamate

Objective

To determine physical properties of high active paste (approximately 9% water) with sodium glutamate.

Preparation

Equipment: A falling film $SO_3$ reactor is used to prepare the acid form of $C_{14-15}$ alkyl sulfate (HAS). The acid form of $C_{12.3}$ linear alkyl benzene sulfonate (HLAS) is mixed into the HAS in an 88/12 HAS/-HLAS ratio. The acid is fed to a high active neutralization system (HAN) supplied by Chemithon Corporation of Seattle Wash. This customized neutralization system consists of a recycle loop containing heat exchangers for cooling, a recirculation pump, and a high shear mixer with which the reactants are introduced.

In order to attain suitable moisture levels for particle formation, the neutralization loop is modified to handle 70% sodium hydroxide melt. This modification consists of -hot water jackets and electrical heating of the cooler to maintain the 70% caustic above the caustic melting point of about 155° F. (68.3° C.), and addition of a low pressure drop cooler and a pump capable of handling high viscosity (Moyno pump, Robbins & Myers, Springfield, Ohio). The modified system is called an ultra high active neutralization system (UHAN).

Other modifications are the addition of metering systems which inject polyethylene glycol (PEG) and disodium glutamate (DSG) into the neutralization loop at the discharge side of the high shear mixer. The PEG has an average molecular weight of 8000 and is added as a 160° F. (71.1° C.) melt at a rate of 1 part per 10 parts of active surfactant. The PEG improves pumpability and physical properties of the subsequent particles. The DSG solution is made from crystalline monosodium glutamate at 50% dissolved in 140° F. (60° C.) water and titrated with 50% NaOH to pH=11. The DSG is added at a rate of 1 part per 40 parts of active surfactant. DSG provides better alkalinity control in the loop, reduces the paste viscosity, and prevents discoloration.

The molten paste is fed to a chill roll, which forms a thin, solid sheet that is sticky. This sheet is fed to a rotary dryer where the flake moisture is reduced from 10% to under 2%. The dried flakes are then ground manually in an impact grinder, and screened to the desired particle size.

Operation: At start up, the neutralization loop is filled with water and the system is maintained at 180°–230° F. (82.2°–110° C.) by using hot water. The recycle pump and high shear mixer are started.

The 88/12 mixture of HAS/HLAS is fed into the high shear mixer and allowed to react. The sodium hydroxide, DSG and HAS/HLAS are metered to maintain a pH of approximately 9.7. Material displaced from the recirculation loop is discharged through a back pressure control valve. As operation continues, the water is displaced from the loop and the concentration of the neutralized AS/LAS is increased to over 70% active.

Once the desired active level is reached, the paste stream is diverted to the chill roll. 40° F. (4.4° C.) cooling water is used to cool the sheets of paste to approximately 80° F. (26.7° C.). The cool flakes are stored in air tight drums. The flakes are then batch dried in a rotary mixer from about 10% to below about 2% moisture, keeping flake temperatures under 250° F. (121.1° C.) to prevent flake degradation. Each batch is allowed to cool to room temperature, and is ground with an impact grinder. The ground material is sieved to remove material larger than 20 Tyler mesh.

Experimental results:

Detergent Particles Composition: (calculated based on paste composition prior to drying)

| Component | % By Weight |
|---|---|
| $C_{14-15}$ Sodium alkyl sulfate | 71.8% |
| $C_{12.3}$ LAS | 10.5% |
| Water | 1.5% |
| PEG 8000 | 7.9% |
| Misc. (sulfate, NaOH, etc) | 3.7% |
| Unreacted alcohol | 2.6% |
| Disodium glutamate | 2.0% |

The paste and the resultant particles are bright white in color. No discoloration is observed when perfume is sprayed on the flakes. No gas generation is observed. The flake product has a sweet, honey like odor. This flake product is acceptable for use in granular laundry detergent compositions.

Pressure drops through the heat exchanger are 88 psi for a Recycle Ratio of 22. (Recycle ratio is the mass flow in the loop divided by the product stream mass flow.) This pressure drop is much lower than what would be expected for a non-DSG system at that recycle ratio, indicating a reduction in viscosity in the paste, which improves processability.

Alkalinity control of the loop is excellent. Alkalinity ranges from 9.8 to 10.3 over a several hour period. No product degradation is observed.

EXAMPLE II

Neutralization of High Active AS/LAS Paste with Sodium Carbonate

Objective

To determine physical properties of high active paste (approximately 9% $H_2O$) with sodium carbonate.

Preparation/Operation

Preparation and operation are similar to Example I, except sodium carbonate is used instead of DSG, at approximately 1 part carbonate per 80 parts active AS/-LAS. Sodium carbonate is fed into the neutralization loop in a similar manner as DSG, by using a 30% solution at 140° F. (60° C.).

Experimental results:

Detergent Particles Composition: (calculated based on paste composition prior to drying)

| Component | % By Weight |
|---|---|
| $C_{14-15}$ Sodium alkyl sulfate | 71.6% |
| $C_{12.3}$ LAS | 10.9% |
| Water | 1.5% |
| PEG 8000 | 6.6% |
| Misc. (sulfate, NaOH. etc.) | 4.7% |
| Unreacted alcohol | 3.6% |
| Sodium carbonate | 1.1% |

The paste and the resultant particles are white in color. No discoloration is observed when perfume is sprayed on the flakes. $CO_2$ gas bubble generation is observed, which affects the flake integrity. Flakes are unacceptably sticky and difficult to process. The flake product has an unacceptable faint sour odor, having some of the odor characteristics of the acid form. This flake product is unacceptable for use in granular laundry detergent compositions.

Pressure drops through the heat exchanger are 106 psi for a Recycle Ratio of 21. (Recycle ratio is the mass flow in the loop divided by the product stream mass flow.) This pressure drop is somewhat lower than what would be expected for a non-carbonate paste at that recycle ratio, indicating a reduction in viscosity in the paste, which improves processability.

Alkalinity control of the loop is good. Alkalinity ranges from 9.8 to 10.5 as caustic levels are adjusted.

EXAMPLE III

Neutralization of High Active AS/LAS Paste without Sodium Glutamate

Objective

To determine physical properties of high active paste (approximately 9% $H_2O$) without added glutamate or carbonate.

Preparation/Operation

Preparation and operation are similar to Example I, except that glutamate and carbonate are not added. Excess sodium hydroxide is used to control the alkalinity of the paste and to prevent reversion.

Experimental results:

Detergent Particles Composition: (calculated based on paste composition prior to drying)

| Component | % By Weight |
|---|---|
| $C_{14-15}$ Sodium alkyl sulfate | 72.6% |
| $C_{12.3}$ LAS | 10.9% |
| Water | 1.4% |
| PEG 8000 | 7.4% |
| Misc. (sulfate, NaOH, etc.) | 3.1% |
| Unreacted alcohol | 4.6% |

The paste and the resultant particles are off-white in color. A dark yellow discoloration is observed when perfume is sprayed on the flakes. Perfume impact is reduced to a very low level after several days of contact with the particles. This flake is unacceptable for use in granular laundry detergent compositions. No gas generation is observed. The flake product has a faint spicy-sweet odor.

Pressure drops through the heat exchanger are 105 psi for a Recycle Ratio of 10. (Recycle ratio is the mass flow in the loop divided by the product stream mass flow.) This pressure drop is average for a non-buffer paste.

Alkalinity control of the loop is fair. Caustic level must be constantly readjusted to compensate for changes in paste alkalinity.

What is claimed is:

1. A process for producing high active detergent particles, comprising the steps of:

(a) reacting in a continuous high active neutralization loop, the acid form of an anionic surfactant with an alkali metal hydroxide solution, which is about 30 to 75% by weight of the hydroxide and is present in stoichiometric amount to slight stoichiometric excess, to produce a neutralized product;

(b) adding to said continuous high active neutralization loop, during formation of said neutralized product, an α-aminodicarboxylic acid selected from the group consisting of glutamic acid, aspartic acid, aminomalonic acid, aminoadipic acid and 2-amino-2-methyl-pentanedioic acid, or their alkali metal salts; and (c) forming detergent particles from the molten neutralized product of step (b) by cooling and sequentially or concurrently prilling, extruding, granulating or flaking, said particles comprising from about 50 to 90 weight % of the anionic surfactant and from about 0.2 to 15 weight % of the α-aminodicarboxylic acid salt.

2. A process according to claim 1, wherein an alkali metal salt of glutamic acid or aspartic acid is added to the neutralization loop.

3. A process according to claim 3, wherein the alkali metal hydroxide solution is about 62 to 73% by weight of the hydroxide.

4. A process according to claim 4, wherein rom about 1 to 10 weight % mono- or disodium glutamate is added to the neutralization loop.

5. A process according to claim 4, wherein the acid form of $C_{12-18}$ alkyl sulfate is used.

6. A process according to claim 5, wherein the alkali metal hydroxide solution is sodium hydroxide.

7. A process according to claim 6, wherein a mixture of the acid form of $C_{12-18}$ alkyl sulfate and $C_{10-16}$ linear alkyl benzene sulfate are reacted with the sodium hydroxide so that the final ratio of $C_{12-18}$ sodium alkyl sulfate to $C_{10-16}$ sodium linear alkyl benzene sulfonate is between about 75:25 and 96:4.

8. A process according to claim 7, wherein said mixture is of the acid form of $C_{14-16}$ alkyl sulfate and $C_{11-14}$ linear alkyl benzene sulfate or $C_{12-18}$ fatty acid.

9. A process according to claim 8, wherein said neutralized product has less than or equal to about 12% by weight of water.

10. A process according to claim 1, comprising the additional step of adding to the neutralization loop during formation of said neutralized product, polyethylene glycol of a molecular weight between about 4,000 and 50,000; ethoxylated nonionic surfactant of the formula $R(OC_2H_4)_nOH$, wherein R is a $C_{12-18}$ alkyl group or a $C_{8-16}$ alkyl phenol group and n is from about 9 to about 80, with a melting point of greater than or equal to about 120° F. (48.9° C.); or mixtures thereof in a weight ratio of from about 1:5 to 1:20 with the ingredients of step (a).

11. A process according to claim 10, wherein polyethylene glycol of a molecular weight between about 7,000 and 12,000 is added.

12. A process according to claim 11, wherein said neutralization loop is insulated and comprises a high shear mixer, positive displacement pump and a cooler.

13. A process according to claim 12, wherein incoming acid and caustic streams to said neutralization loop are positioned at the high shear mixer, and additives are metered in after said high shear mixer and before said positive displacement pump in said neutralization loop.

14. A process according to claim 1 comprising simultaneous cooling and extruding molten neutralized product, and cutting or grinding into detergent particles.

15. A process according to claim 1 comprises cooling said product of step (b) on a chill roll until it has solidified, and flaking said solidified product off said chill roll into detergent flakes, drying to below about 5% moisture, and mechanically grinding into detergent particles.

16. A process according to claim 1, wherein the acid form of $C_{12-18}$ methyl ester sulfonate is used.

17. A process according to claim 1, wherein said particles comprise from about 75 to 85 weight % of said anionic surfactant.

* * * * *